US010699833B2

(12) United States Patent
Groffen et al.

(10) Patent No.: US 10,699,833 B2
(45) Date of Patent: Jun. 30, 2020

(54) MAGNET ASSEMBLY

(71) Applicant: Sonion Nederland B.V., Hoofddorp (NL)

(72) Inventors: Camiel Eugène Groffen, Hoofddorp (NL); Wouter Bruins, Hoofddorp (NL); Caspar Titus Bolsman, Hoofddorp (NL); Gerardus Johannes Franciscus Theodorus van der Beek, Hoofddorp (NL); Jan Hijman, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 106 days.

(21) Appl. No.: 15/856,368

(22) Filed: Dec. 28, 2017

(65) Prior Publication Data

US 2018/0182524 A1 Jun. 28, 2018

(30) Foreign Application Priority Data

Dec. 28, 2016 (EP) ..... 16207101

(51) Int. Cl.
*H01F 7/00* (2006.01)
*H01F 7/16* (2006.01)
(Continued)

(52) U.S. Cl.
CPC ..... *H01F 7/1615* (2013.01); *H01F 7/127* (2013.01); *H01F 7/1623* (2013.01);
(Continued)

(58) Field of Classification Search
CPC ..... H01F 7/16; H01F 7/1615; H01F 7/1623; H01F 41/02; F01F 13/003
(Continued)

(56) References Cited

U.S. PATENT DOCUMENTS 6,788,796 B1 9/2004 Miles
6,831,577 B1 12/2004 Furst
(Continued)

FOREIGN PATENT DOCUMENTS

CN 204761697 U 11/2015
CN 105187987 A 12/2015
(Continued)

OTHER PUBLICATIONS

Extended European Search Report in European Patent Application No. EP 16207101, dated May 18, 2017 (3 pages).
(Continued)

*Primary Examiner* — Shawki S Ismail
*Assistant Examiner* — Lisa N Homza
(74) *Attorney, Agent, or Firm* — Nixon Peabody LLP

(57) ABSTRACT

The present invention provides a receiver comprising a housing, an armature, and a magnet assembly, where the armature and the magnet assembly are arranged in the housing. The magnet assembly comprises a magnet and a magnet shell. The magnet shell forms an inner space in which the magnet is provided, and where at least a part of the armature extends in the inner space. The magnet shell comprises at least two shell parts forming an inner surface encircling the inner space, where each of the shell parts comprises a first and a second end face. The first end face of a first shell part abuts one of the first and second end faces of an adjacent shell part, and the second end face of the first shell part abuts one of the first and second ends faces of an adjacent shell part.

20 Claims, 9 Drawing Sheets

(51) Int. Cl.

| | |
|---|---|
| ***H01F 41/02*** | (2006.01) |
| ***H01F 7/127*** | (2006.01) |
| ***H01F 13/00*** | (2006.01) |
| ***H04R 11/02*** | (2006.01) |
| *H04R 25/00* | (2006.01) |
| *H04R 9/02* | (2006.01) |
| *H04R 31/00* | (2006.01) |
| *H04R 9/06* | (2006.01) |

(52) U.S. Cl.
CPC ..... *H01F 13/003* (2013.01); *H01F 41/0206* (2013.01); *H04R 11/02* (2013.01); *H04R 9/025* (2013.01); *H04R 9/06* (2013.01); *H04R 25/65* (2013.01); *H04R 31/006* (2013.01); *H04R 2225/021* (2013.01); *H04R 2225/023* (2013.01); *H04R 2225/025* (2013.01)

(58) Field of Classification Search
USPC ..... 335/229
See application file for complete search history.

(56) References Cited

U.S. PATENT DOCUMENTS 6,853,290 B2 2/2005 Jorgensen
6,859,542 B2 2/2005 Johannsen
6,888,408 B2 5/2005 Furst
6,914,992 B1 7/2005 van Halteren
6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 * 6/2006 Hansen ..... H04R 7/12 381/152
7,072,482 B2 7/2006 Van Doorn
7,088,839 B2 * 8/2006 Geschiere ..... H04R 25/604 381/324
7,110,560 B2 9/2006 Stenberg
7,136,496 B2 11/2006 van Halteren
7,142,682 B2 11/2006 Mullenbom
7,181,035 B2 2/2007 van Halteren
7,190,803 B2 * 3/2007 van Halteren ..... H04R 11/02 381/398
7,206,428 B2 4/2007 Geschiere
7,221,767 B2 5/2007 Mullenbom
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 * 2/2009 Engbert ..... H04R 7/18 381/324
7,548,626 B2 6/2009 Stenberg
7,657,048 B2 2/2010 van Halteren
7,684,575 B2 3/2010 van Halteren
7,706,561 B2 * 4/2010 Wilmink ..... H04R 7/18 381/324
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 * 3/2011 Van Halteren ..... H04R 11/02 381/396
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 * 1/2012 van Halteren ..... H04R 1/24 381/182
8,101,876 B2 1/2012 Andreasen
8,103,039 B2 1/2012 van Halteren
8,160,290 B2 * 4/2012 Jorgensen ..... H04R 25/604 381/322
8,170,249 B2 5/2012 Halteren
8,189,804 B2 5/2012 Hruza
8,189,820 B2 5/2012 Wang
8,223,996 B2 * 7/2012 Beekman ..... H04R 11/02 381/152
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 * 12/2012 van Halteren ..... H04R 25/60 381/328
8,369,552 B2 2/2013 Engbert
8,379,899 B2 2/2013 van Halteren
8,509,468 B2 * 8/2013 van Halteren ..... H04R 1/22 381/355
8,526,651 B2 9/2013 Lafort
8,526,652 B2 9/2013 Ambrose
2006/0140436 A1 6/2006 de Moel
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2011/0311091 A1 * 12/2011 Nagumo ..... H04R 11/02 381/398
2012/0014548 A1 * 1/2012 van Halteren ..... H04R 25/60 381/325
2012/0027245 A1 2/2012 van Halteren
2012/0140966 A1 * 6/2012 Mocking ..... H04R 11/02 381/322
2012/0155683 A1 6/2012 van Halteren
2012/0155694 A1 * 6/2012 Reeuwijk ..... H04R 11/02 381/396
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren

FOREIGN PATENT DOCUMENTS

CN 105228045 A 1/2016
EP 1962551 A2 8/2008
EP 2464141 A2 6/2012
WO WO 2015/057519 A1 4/2015

OTHER PUBLICATIONS

Extended European Search Report in European Patent Application No. EP 17210953, dated Mar. 13, 2018 (6 pages).

* cited by examiner

MAGNET ASSEMBLY

CROSS-REFERENCES TO RELATED APPLICATIONS

This application claims the benefit of European Patent Application Serial No. 16207101.3, filed Dec. 28, 2016, which is incorporated herein by reference in its entirety.

FIELD OF THE INVENTION

The present invention relates to a receiver comprising a magnet assembly comprising a magnet and a magnet shell. Furthermore, the invention relates to a method of manufacturing the receiver, and to the magnet assembly itself.

BACKGROUND OF THE INVENTION

Traditionally, the manufacturing of a receiver comprising a magnet assembly is complicated due to the large number of small parts which have to be assembled. Furthermore, the magnetic interface may complicate the manufacturing process.

Prior art document EP 2 464 141 discloses a transducer assembly with a U-shaped armature. At least a part of the U-shaped armature forms part of the magnet housing.

EP 1 962 551 discloses a moving armature receiver. The receiver comprises a magnet housing being formed partly by legs of the armature.

CN 105 187 987 discloses a magnetic drive mechanism and a receiver comprising the magnetic drive mechanism. The magnet is attached directly to the receiver housing to omit a magnet shell.

US 2005/140436 discloses a method and a system for assembling of electroacoustic transducers. A magnet shell is formed by shell parts and by legs of an E-shaped armature.

US 2011/0311091 discloses an acoustic conversion device comprising a yoke with adjustable size for optimisation of the distance between the magnets.

DESCRIPTION OF THE INVENTION

It is an object of embodiments of the invention to provide an improved receiver.

It is a further object of embodiments of the invention to provide an improved manufacturing process.

It is an even further object of embodiments of the invention to provide a receiver which facilitate assembling of the receiver and magnet assembly.

According to a first aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, wherein the magnet shell comprises at least two shell parts forming an inner surface substantially encircling the inner space, and wherein the shell parts each comprises a first and a second end face, the first end face of a first shell part abuts one of the first and second end faces of an adjacent shell part, the second end face of the first shell part abuts one of the first and second end faces of an adjacent shell part.

Thus, each shell part comprises a first end face and a second end face; i.e. free ends terminating the shell part at opposite ends hereof. Each shell part further comprising an outer surface part and an inner surface part, where the end faces forms an edge arranged in the transition between the outer surface part and the inner surface part. When the magnet shell is assembled by two or more shell parts, each outer surface part forms part of the outer surface of the magnet shell, whereas each inner surface part forms part of the inner surface encircling the inner space. This is achieved by assembling the shell parts so that each end face of a shell part abuts an end face of an adjacent shell part.

The receiver may be adapted to form part of any personal audio device, such as a hearing aid, such as a Behind-the-Ear (BTE) device, an In the Ear (ITE) device, a Receiver in the Canal (RIC) device, a Completely-in-Canal device (CIC), or any other personal audio device, such as headphones, earphones, and other earpieces. In the context of the present invention, the term "hearing aid" shall be understood as a device which is adapted to amplify and modulate sound and to output this sound to a user, such as into the ear canal of a user.

It should further be understood, that the receiver in one embodiment may be a balanced armature receiver, whereas the receiver in other embodiments may also comprise other transducer technologies, such as moving coil, moving armature, magnetostatic, etc.

Thus, the receiver may be adapted to receive an electrical signal and output a corresponding audio signal through a sound outlet.

The receiver comprises a magnet assembly. The magnet assembly is arranged to provide a magnetic field in a gap. The gap may be an air gap or a gap filed with a substance, such as ferromagnetic fluids, depending on the transducer technology in which the magnet assembly is to be used. The receiver comprises an armature of which at least a part extends in the inner space; i.e. the armature may comprise at least one leg extending at least partly through the gap.

The armature and magnet shell may be made from any type of suitable material, such iron and Nickel, capable to guide or carry a magnetic flux. Examples of these materials are, but are not limited to the different types of materials mentioned in the ASTM A753 standard. The materials may be electrically conducting or not. The armature and the magnet shell may be made of the same material. I should however be understood, that the armature and the magnet shell may be made from different materials.

The receiver may further comprise a diaphragm which is operationally attached to the armature, such that movement of the armature is transferred to the diaphragm. It will be appreciated that movement of the diaphragm causes sound waves to be generated. In one embodiment, the diaphragm is operationally attached to the armature by means of a diaphragm connecting member, such as a drive pin. Alternatively, the diaphragm may itself be attached to the armature.

The diaphragm may comprise a metal material such as aluminium, nickel, stainless steel, or alternatively a plastic material, such as a polymer, e.g. nylon, ABS, acryl, or any other material. It should however be understood, that the diaphragm may comprise a plurality of materials. The diaphragm may divide the chamber into two chambers, such as a front volume and a back volume.

The receiver may be located in an assembly housing which itself may form a soft shell or which may be located in a shell made of a soft material, such as silicone, to improve comfort of a user. To improve comfort further, an individual shell may be made for each user to fit the ear of the user. Other suitable materials for the assembly housing may be nylon, ABS (plastic), and metals, such as stainless steel, aluminium and titanium.

A traditional magnet assembly comprises a magnet shell formed in one piece and forming an inner space in which one or more magnets are provided. However, positioning of the magnet(s) may be difficult due to the size and due to requirements and tolerance relating to the magnetic interface.

The inventors have surprisingly found that in contradiction with traditional practice, it may be possible to provide the magnet shell of at least two parts. To ensure sufficient magnetic properties of the magnet shell, the magnet shell when assembled of the at least two shell parts should form an inner space having a common inner surface. Or in other words, an inner space being encircled of an uninterrupted surface, and the magnet is provided in that inner space.

In the context of the present invention, the term "uninterrupted surface" should be understood as a common surface formed by surfaces of the at least two shell parts when these are assembled, the surface not being interrupted by other elements. As an example, other elements of the receiver/magnet assembly may not be inserted in a joint between two adjacent shell parts. Thus, when assembled the magnet shell forms a separate element without the inclusion of other parts of the receiver, such as the armature and the housing.

Furthermore, the term "a space being encircled" should be understood as a space being enclosed in, i.e. surrounded by the magnet shell in a cross-section perpendicular to the magnet. It should further be understood, that the inner space may be open at least at one end. I.e. the magnet shell may be ring-shaped, however of arbitrary form, such as square-shaped or oval.

The term "common surface" should be understood, as a surface being constituted by parts of surfaces of the shell parts which together form the magnet shell.

Thus, the at least two shell parts forms an inner surface being uninterrupted and encircling the inner space.

By providing the magnet shell by at least two shell parts it may be possible to attached the magnet to at least one of the shell parts before assembling magnet shell, thereby facilitate the assembling procedure.

The inner space may have height being defined as the distance between an upper shell part and a lower shell part in a direction substantially perpendicular to the armature which at least partly extends in the inner space. The inner space may define one or more discrete predefined heights. In one embodiment, only a single height may be defined, as the shell parts may be assembly in only one possible way thereby only providing a single height. In an alternative embodiment, the magnet shell may be assembled in different ways thereby providing two or more heights of the inner space.

As an example, the latter may be achieved by assembling the magnet shell of two U-shaped shell parts have legs of different length; i.e. a short leg and a long leg. If the two short legs and the two long legs abut, the height will be different than if each short leg abut a long leg.

To minimise the number of different parts forming the magnet shell, a first shell part and a second shell part may be substantially identical. It should however be understood, that these shell parts may in another embodiment be of different shape. An embodiment comprising a first shell part and a second shell part being identical may further comprise a third and even a fourth shell part or more of different shape.

It may in one embodiment be an advantage to provide the shell parts of different shape to compensate for different magnetic resistances, such as if the armature is a U-shaped armature or if the receiver is configured to have the magnetic flux going through the receiver housing.

In one embodiment, the magnet shell comprises two shell parts being identical; i.e. having same size and shape. Each of the two shell parts may be substantially U-shaped; i.e. being formed by two substantially parallel legs each being attached to an intermediate portion at an end part to thereby form a "U". It should be understood, that each of the two U-shaped shell parts may be formed in one piece. Thus, the term "attached to" may also cover elements formed in one piece.

When assembling the magnet shell of the two identical shell parts, the shell parts may abut each other at the free end of the legs; i.e. the end not being attached to the intermediate portion.

Alternatively, each of the two shell parts may be substantially L-shaped; i.e. being formed by two legs being attached to each other at an end part and extending there from at an angle of approximately 90 degrees to thereby form a "L". It should be understood, that each of the two L-shaped shell parts may be formed in one piece. Thus, the term "attached to" may also cover elements formed in one piece.

When assembling the magnet shell of the two identical shell parts being L-shaped, the shell parts may abut each other at a side portion of the free end of the legs; i.e. the ends not being attached to the other leg. It should be understood, that the first and second legs of the L-shaped shell parts may be of different length.

By forming the magnet shell of two substantially identical shell parts, the manufacturing process may be more efficient due to the lower number of different elements forming part of the receiver. Furthermore, assembling of the receiver may be facilitated, as the assembled magnet shell may be turned upside down without changing the magnet shell and its functionality.

To facilitate handling of the magnet shell, the at least two shell parts may in one embodiment form a smooth outer surface. In the context of the present invention, the term "smooth surface" should be understood as a surface substantially without protrusions and indentations.

The shell parts may have a thickness being defined as a distance from the inner surface to an opposite outer surface. In one embodiment, the thickness may be non-uniform along the inner space.

The magnet shell may comprise a protecting layer arranged on the outer surface of the magnet shell. The protecting layer, e.g. a copper layer, may be arranged to reduce electromagnetic radiation from the magnet assembly. The protecting layer may be arranged on the outer surface of the magnet shell after assembling of the at least two shell parts.

Additionally or alternatively, a sealing layer may be arranged on the outer or inner surface of the magnet shell after assembling of the at least two shell parts. The sealing layer may be arranged solely along a joint of two adjacent shell parts or it may be arranged on a larger part of the outer surface, such as fully covering the outer or inner surface. The sealing layer may be arranged for corrosion protection. As an example, nano-coating may be used to provide the sealing layer.

The sealing layer may in one embodiment be added in a two-step process. In a first step, the sealing lay may be added as a primer on the magnet shell. In a second step when assembling the receiver, an additional sealing layer may be added. The additional sealing layer may then connect to the primer.

In order to assemble the magnet shell having a common inner surface and thereby an uninterrupted inner surface, the shell parts each comprises a first and a second end face, i.e. each shell part extends between a first end face and a second end face. When assembling the magnet shell, the first end face of a first shell part may abut one of the first and second end faces of an adjacent shell part. Furthermore, the second end face of the first shell part abuts one of the first and second ends faces of an adjacent shell part.

Thus, if the magnet shell comprises two shell parts, they are arranged end face to end face to provide an inner space having a common inner surface; i.e. the first end face of the first shell part abuts the second end face of the second shell part and the second end face of the first shell part abuts the first end face of the second shell part or oppositely; the first end face of the first shell part abuts the first end face of the second shell part and the second end face of the first shell part abuts the second end face of the second shell part.

It should be understood, that if an embodiment comprises three or more shell parts an end face of a shell part abuts an end face of an adjacent shell part, etc. to provide an inner space having a common inner surface. Thus, the three of more shell parts may be arranged in series to provide a common inner surface being an uninterrupted inner surface of the inner space.

When assembling the shell parts to form a magnet shell, it may be an advantage if the tolerances are kept below a threshold value, as assembling e.g. by welding of two adjacent shell parts may be facilitated if the end faces fit each other within a low tolerance level. This may be achieved by keeping the roughness of the end face at which adjacent shell parts abut below a certain threshold value, e.g. by ensuring that the roughness does not exceed 5, 10, or 15 microns as a higher roughness may increase the risk of air bobbles in the joint. Such air bobbles should be avoided, or at least the risk of bobbles should be minimized considerably, as bobbles may decrease the magnetic performance due to discontinuities in the material. The above mentioned threshold values may be especially suitable for receivers having a length in the range of 5-15 mm.

For larger receivers were the contact area of two adjacent shell parts may be larger, the threshold values may also be larger. Magnet assemblies having a relatively large contact area between two adjacent shell parts may be assembled by a process including pressing the two shell parts together as this may limit the number of gaps and air bobbles which may be removed when pressing them together, as pressing may additionally at least partly deform the material from which the shell parts are made.

To facilitate assembling of the magnet shell, the receiver may further comprise an alignment structure for alignment of the at least two shell parts.

The alignment structure may form part of the magnet shell, e.g. by forming part of at least one of the shell parts. However, it should be understood, that the alignment structure may also be a separate element. As an example, an alignment structure in the form of a separate element may be arranged at one of the shell parts, and subsequently the other one or other ones can be arranged to form the magnet shell while being supported by the alignment structure. Thus, in one embodiment, the alignment structure may be in the inner space supporting the shell parts during assembling. The alignment structure may subsequently be removed again.

An alignment structure forming part of the magnet shell may as an example form part of one or more of the end faces of one or more of the shell parts.

It should be understood, that the alignment structure may comprise a combination of a separate element and an element forming part of the magnet shell.

In one embodiment, the alignment structure may comprise a geometrical locking structure forming part of the shell parts. As an example, the geometrical locking structure may comprise matching indentations and protrusions on shell parts abutting each other. It should be understood, that the geometrical locking structure may in one embodiment form an indentation at one shell part matching the end face at the other shell part; i.e. the end face itself may form a protrusion matching an indentation at the other shell part.

The matching indentations and protraction may comprise teeth and corresponding spaces, where the teeth may be square-shaped, round, serrated, and other similar forms adapted to lock two parts together.

The geometrical locking structure may be formed along the abutting end faces or transverse to the abutting surfaces.

The magnet may comprise a first magnet portion and a second magnet portion to provide a magnetic field. In one embodiment, the first magnet portion and the second magnet portion may be attached to different shell parts.

The magnet and the magnet portion may be attached to the shell parts by gluing or welding. It should however be understood that other means of attachment may also be used, such as clamping, screwing or by use of a pinhole, etc.

In one embodiment, one magnet portion may be attached by use of one means of attachment, whereas another magnet portion may be attached by use of another means of attachment.

It should be understood, that the magnet/magnet portions may be supported/kept in place by an additional element arranged in the inner space.

In one embodiment, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, and wherein the magnet shell comprises at least two shell parts forming an inner surface substantially encircling the inner space.

According to a second aspect, the invention provides a method of manufacturing a magnet assembly according to the first aspect of the invention, the method comprising the step of;

providing a magnet, providing at least two shell parts each comprising a first and a second end face, providing a housing, providing an armature, assembling the at least two shell parts to form a magnet shell having an inner space with an inner surface substantially encircling the inner space, so that the first end face of a first shell part abuts one of the first and second end faces of an adjacent shell part, and the second end face of the first shell part abuts one of the first and second end faces of an adjacent shell part, attaching the magnet to at least one of the shell parts, and arranging the magnet shell and the armature in the housing.

It should be understood, that a skilled person would readily recognise that any feature described in combination with the first aspect of the invention could also be combined with the second aspect of the invention, and vice versa.

The method according to the second aspect of the invention is very suitable for the manufacturing of a receiver according to the first aspect of the invention. The remarks set forth above in relation to the receiver are therefore equally applicable in relation to the method.

The step of attaching the magnet to at least one of the shell parts may be carried out prior to the step of assembling the shell parts to form a magnet shell, thereby facilitating attachment of the magnet.

Furthermore, the step of attaching the magnet may comprise a step of attaching a first magnet portion to a first shell part and a step of attaching a second magnet portion to a second shell part, as the magnet may comprise two magnet portions.

In one embodiment, the magnet/magnet parts may be magnetized after attachment of the magnet/magnet parts to the magnet shell or even after assembling of the magnet shell.

In another embodiment, the method may comprise a step of magnetizing the magnet prior to the step of assembling the magnet shell.

The step of assembling the magnet shell may comprise a step of gluing the shell parts together. Additionally or alternatively, the step of assembling the magnet shell may comprise a step of welding the shell parts together. It should however be understood, that the shell parts may also be attached to each other my clamping or by other means.

The method may further comprise a step of arranging at least a part of the armature in the inner space of the magnet assembly.

As an example, the armature may be T-shaped or U-shaped.

The U-shaped armature may be formed so that each leg extends from and is attached to an intermediate part which forms the bottom of the U.

The T-shaped armature may comprise two elongated parts which in one embodiment may be of the same length and in an alternative embodiment may be of different length. Each part extends from a first end to a second end. One elongated part may be connected to the other elongated part at a first distance from the first end and a second distance from the second end. The first and second distances may be of the same size.

The first and second part may be formed in one piece. Thus, it should be understood that the term "connected to" both covers embodiments where the two elongated parts of the T-shaped armature are made as a single element, and embodiments where the two elongated parts are made a two separate elements which are subsequently attached to each other.

I.e. a T-shaped armature for a receiver of a personal audio device, the T-shaped armature comprising a first elongated part and a second elongated part, the first and second parts each extending between a first and a second end, wherein the first end of the first part is connected to the second part at a first distance from the first end of the second part and at a second distance from the second end of the second part.

When assembling the receiver, the T-shaped armature may be inserted into a magnet shell, so that at least the second end of the first part is inserted into the magnet shell, such as into the inner space of the magnet shell.

According to a third aspect, the invention provides a magnet assembly for a receiver, the magnet assembly comprising a magnet and a magnet shell, the magnet shell forming an inner space in which the magnet is provided, wherein the magnet shell comprises at least two shell parts forming an inner surface encircling the inner space, and wherein the shell parts each comprises a first and a second end face, and the first end face of a first shell part abuts one of the first and second end faces of an adjacent shell part, the second end face of the first shell part abuts one of the first and second ends faces of an adjacent shell part.

It should be understood, that a skilled person would readily recognise that any feature described in combination with the first and second aspects of the invention could also be combined with the third aspect of the invention, and vice versa.

The features of the receiver according to the first aspect of the invention are very suitable for the magnet assembly according to the third aspect of the invention. Furthermore, the method steps according to the second aspect of the invention are very suitable for the manufacturing of the magnet assembly according to the third aspect of the invention. The remarks set forth above in relation to the receiver and the method are therefore equally applicable in relation to the magnet assembly.

According to a fourth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, the magnet shell comprising at least two shell parts forming an inner surface substantially encircling the inner space, and wherein the magnet assembly comprises an alignment structure for alignment of the at least two shell parts, the alignment structure forming part of the magnet shell.

According to a fifth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, and wherein the magnet shell comprises at least two shell parts forming an inner surface substantially encircling the inner space, the shell parts having a thickness being a distance from the inner surface to an opposite outer surface, and the thickness being non-uniform along the inner space.

According to a sixth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, and wherein the magnet shell comprises two shell parts forming an inner surface substantially encircling the inner space, each of the shell parts being substantially L-shaped in a cross-section.

It should be understood, that the size of the two L-shaped shell part may be of different size.

According to a seventh aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, wherein the magnet shell comprises at least two shell parts forming an inner surface substantially encircling the inner space, and wherein at least one of the shell parts comprises an indentation formed at an end portion, the indentation forming a shape matching a shape of an end portion of another shell part.

According to an eighth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, wherein the magnet shell comprises a first and a second shell part, wherein the first shell part in a cross-section is substantially U-shaped with a first and a second leg and the second shell part in a cross-section is substantially plate-shaped, the plate-shaped shell part having a size which matches a distance between the first and second legs, wherein the shell parts form an inner surface substantially encircling the inner space.

According to a ninth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, wherein the magnet shell comprises a first and a second shell part, each shell part in a cross-section being substantially U-shaped with a first and a second leg extending substantially parallel, and extending towards the other shell part to form an inner surface substantially encircling the inner space, and wherein at least one leg of one shell part forms an overlap with a leg of the other shell part.

According to a tenth aspect, the invention provides a receiver comprising a housing, an armature, and a magnet assembly, the armature and the magnet assembly being arranged in the housing, the magnet assembly comprising a magnet and a magnet shell, the magnet shell forming an inner space in which the magnet is provided, the armature being T-shaped and at least a part of the armature extends in the inner space, wherein the magnet shell comprises at least two shell parts forming an inner surface substantially encircling the inner space.

The T-shaped armature may comprise two elongated parts, each part extending from a first end to a second end. One elongated part may be connected to the other elongated part at a first distance from the first end and a second distance from the second end. The first and second distances may be of the same size.

The T-shaped armature may extend at least partly in the inner space, so that at least the second end of the first part is inserted into the magnet shell.

The second part of the T-shaped armature may be supported at least partly by a shell part; i.e. at least a part of the second part of the T-shaped armature may be arranged in contact with a shell part.

A coil may be arranged in the inner space. In one embodiment, the coil may be fully encircled by the magnet shell.

It should be understood, that a skilled person would readily recognise that any feature described in combination with the first and second aspects of the invention could also be combined with any of the fourth, fifth, sixth, seventh, eighth, ninth, and tenth aspects of the invention, and vice versa. It should further be understood, that a skilled person would readily recognise that any feature described in combination each of the first to tenth aspects of the invention could also be combined with any of the first to tenth aspects of the invention.

The remarks set forth above in relation to the receiver and the method are therefore equally applicable in relation to any of the receivers of the different aspects.

BRIEF DESCRIPTION OF THE DRAWINGS

Embodiments of the invention will now be further described with reference to the drawings, in which.

DETAILED DESCRIPTION OF THE DRAWINGS

It should be understood that the detailed description and specific examples, while indicating embodiments of the invention, are given by way of illustration only, since various changes and modifications within the spirit and scope of the invention will become apparent to those skilled in the art from this detailed description.

Figure 1A:
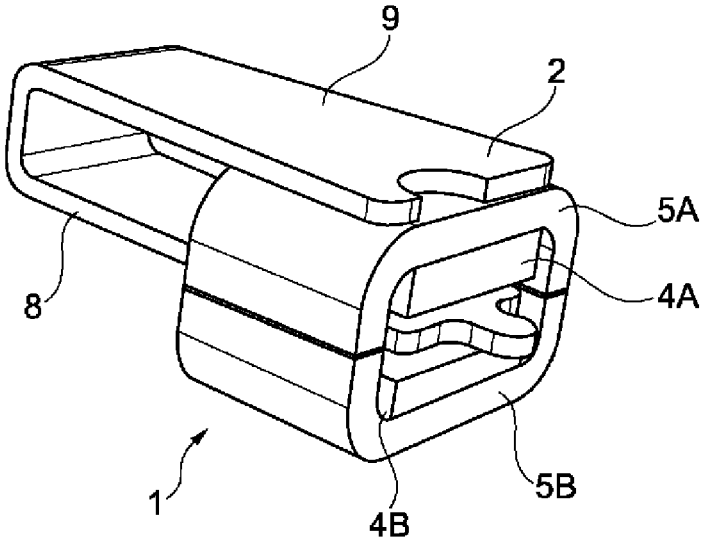
FIGS. 1A-1B illustrate two different views of an embodiment of a magnet assembly and an armature.
Figure 1B:
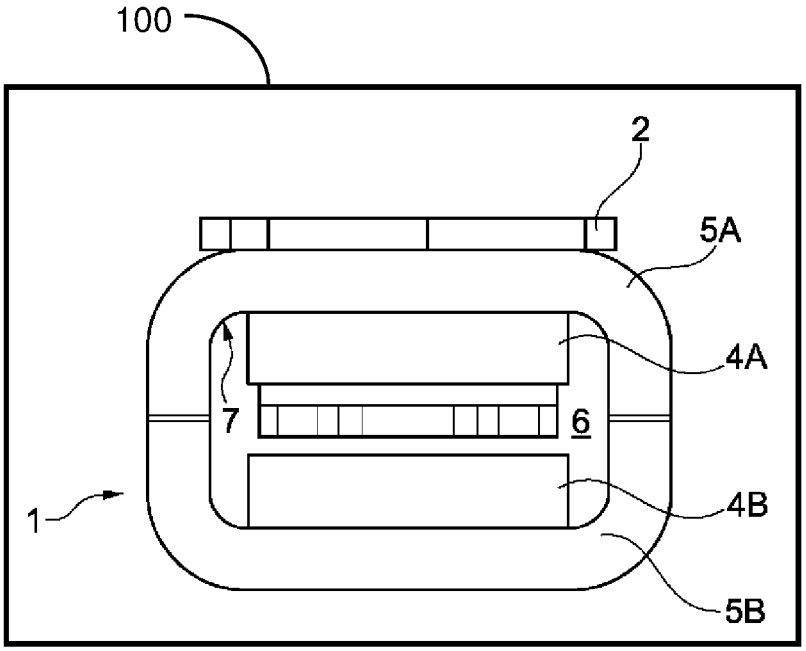

FIGS. 1A-1B illustrate two different views of an embodiment of a magnet assembly 1 and an armature 2 for a receiver having a housing 100 (shown in FIG. 1B). The magnet assembly 1 comprises a magnet 4A, 4B and a magnet shell 5. The magnet shell 5 forms an inner space 6 in which the magnet 4A, 4B is provided.

The magnet shell 5 comprises in the illustrated embodiment two shell parts 5A, 5B forming a common inner surface 7 encircling the inner space 6.

The magnet shell 5 may comprises a protecting layer (not shown) arranged on the outer surface of the magnet shell. The protecting layer, e.g. a copper layer, may be arranged to reduce electromagnetic radiation from the magnet assembly 1.

The armature is U-shaped and a first leg 8 extends through the inner space 6 formed by the magnet shell 5. A second leg 9 of the U-shaped armature extends substantially parallel to the first leg 8.

The receiver may further comprise a diaphragm (not shown) which is operationally attached to the armature 2, such that movement of the armature 2 is transferred to the diaphragm 10. The receiver may comprise a drive pin operatively attaching the diaphragm to the armature 2. Movement of the diaphragm will cause sound waves to be generated.

FIGS. 2A-2D illustrate different views of an alternative embodiment of a magnet assembly 101, a T-shaped armature 102, and a coil 112. The magnet assembly 101 comprises a magnet 104 and two shell parts 105A, 105B forming a common inner surface 107 encircling an inner space 106.

Figure 2A:
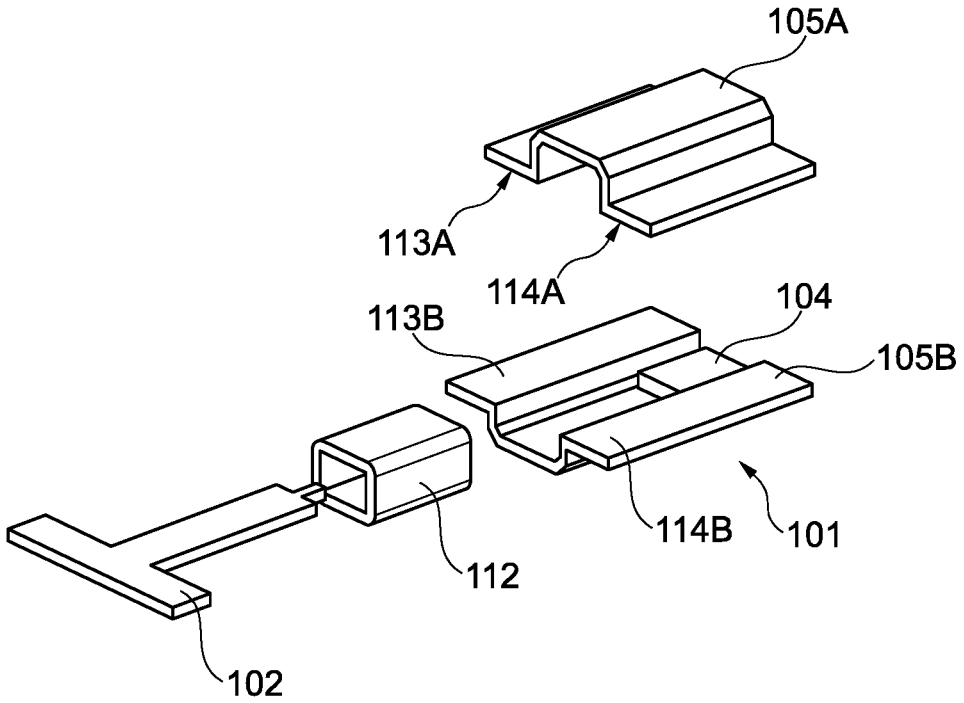
FIGS. 2A-2E illustrate different views of an embodiment of a magnet assembly, an armature, and a coil.
Figure 2B:
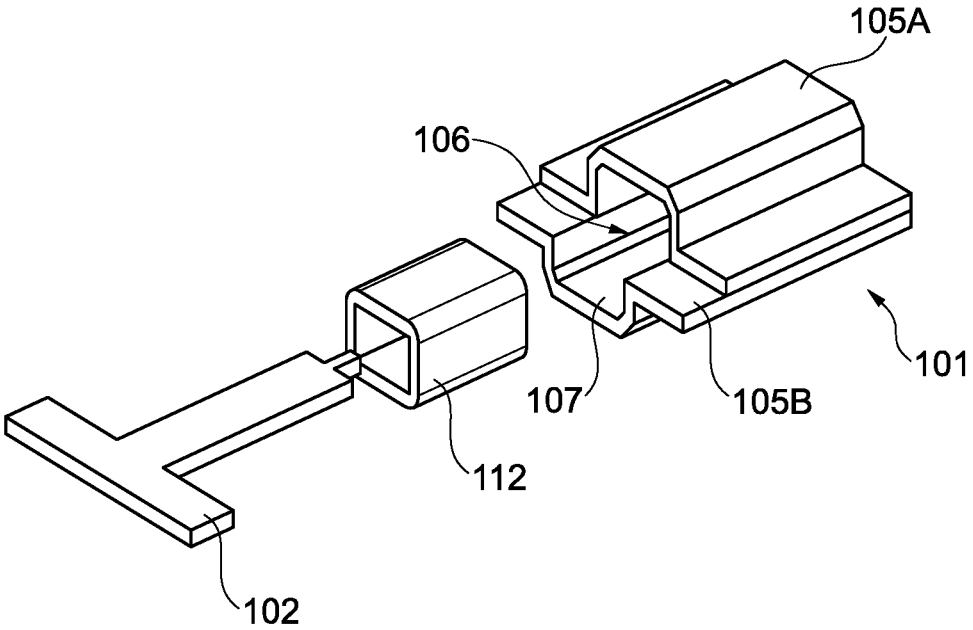

FIG. 2A illustrates the different elements unassembled. In FIG. 2B, the two shell parts 105A, 105B are assembled to form the common inner surface 107 encircling the inner space 106.

The shell parts 105A, 105B may comprises a protecting layer (not shown) arranged on the outer surface of the magnet shell; i.e. a protective layer may be arranged on top of the upper shell part 105A and on the bottom of the lower shell part 105B. The protecting layer, e.g. a copper layer, may be arranged to reduce electromagnetic radiation from the magnet assembly 105.

Figure 2C:
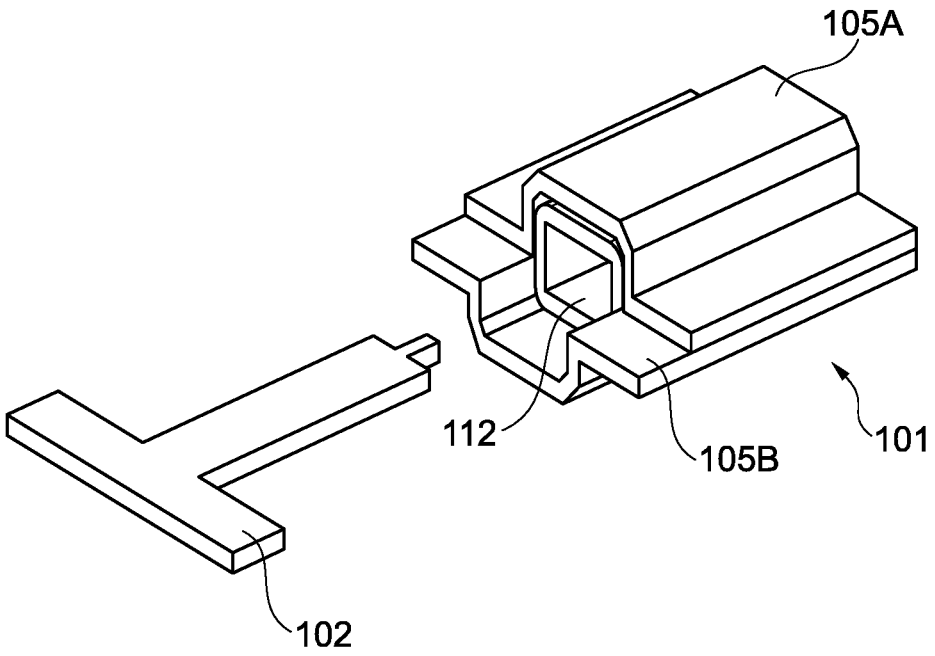
Figure 2D:
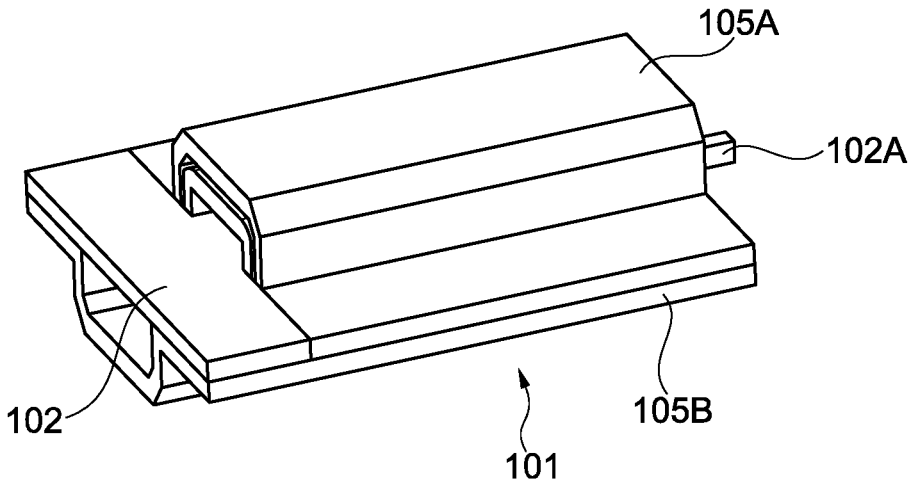
Figure 2E:
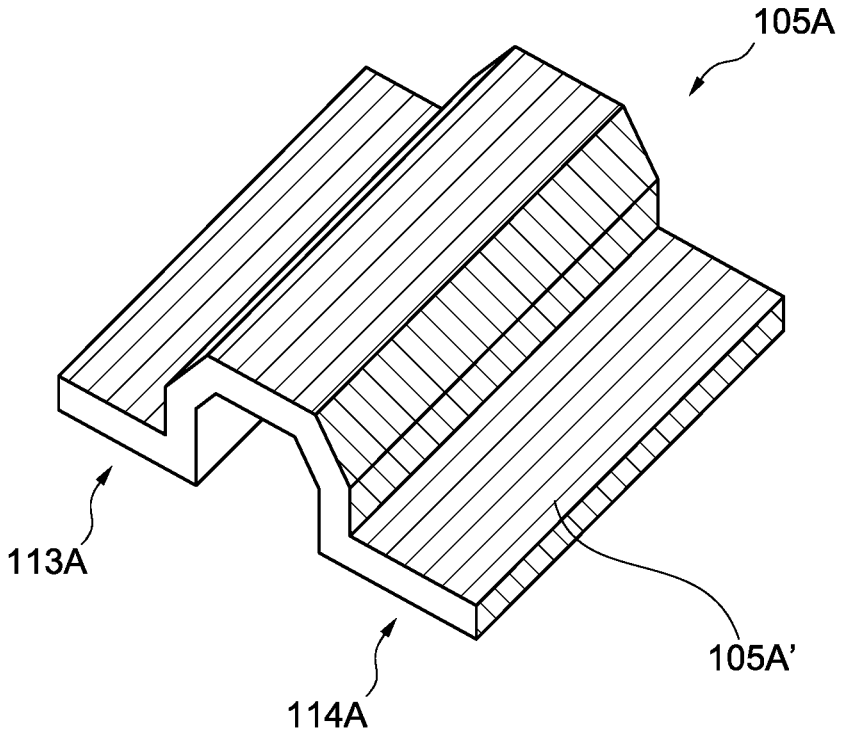

The protective layer 105A' arranged at the upper shell part 105A is illustrated by the hatching in FIG. 2E. It should be understood, that the protective layer may be a primer, a nano-coating, a copper layer, or another shielding material.

The shell parts 105A, 105B each comprises a first joining surface 113 and a second joining surface 114. When assembling the magnet shell 105, the first joining surface 113A of the first shell part 105A abut the first joining surface 113B of the second shell part 105B, and second joining surface 114A of the first shell part 105A abuts the second joining surface 114B of a second shell part 105B. The joining surfaces 113, 114 may as an example be brought together by pressing and deforming the material, such as metals, from which the shell parts 105A, 105B are made.

In FIG. 2C, the coil 112 has been inserted into the inner space 106 formed by the two shell parts 105A, 105B.

The T-shaped 102 armature comprises two elongated parts, each part extending from a first end to a second end. The lower elongated part is connected to the upper elongated part substantially at the middle of the upper elongated part.

In FIG. 2D, the T-shaped armature 102 has been inserted into the inner space 106 formed by the two shell parts 105A, 105B so that the lower part extends through the inner space 106 whereby an end portion 102A extends on the opposite side of the inner space. A drive pin can be attached to the end portions 102A.

The upper part of the T-shaped armature is supported at least partly by the shell part 105B, whereby at least a part of the upper part of the T-shaped armature 102 is arranged in contact with the shell part 105B as also illustrated in FIG. 2D.

FIGS. 3A-3M illustrate different embodiments of a magnet assembly 201, 301, 401, 501, 601, 701, 801.

Figure 3A:
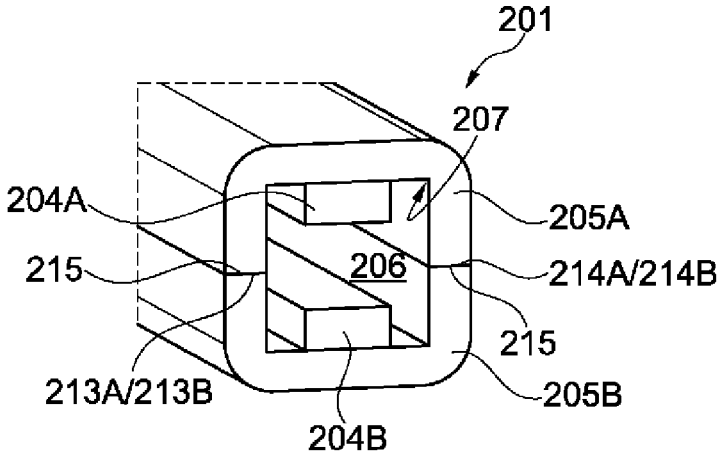
FIGS. 3A-3Q illustrate different embodiments of a magnet assembly.

In FIG. 3A, the magnet assembly 201 comprises a magnet 204 comprising two magnet portions 204A, 204B and two shell parts 205A, 205B forming a common inner surface 207 encircling an inner space 206.

The shell parts 205A, 205B each comprises a first end face 213 and a second end face 214. The end faces 213, 214 abut each other in a joint 215 being parallel to the magnet portions 204A, 204B substantially centrally in a direction along the height of the magnet assembly 201.

In the illustrated embodiment, the shell parts 205A, 205B are substantially identical, both being U-shaped.

Figure 3B:
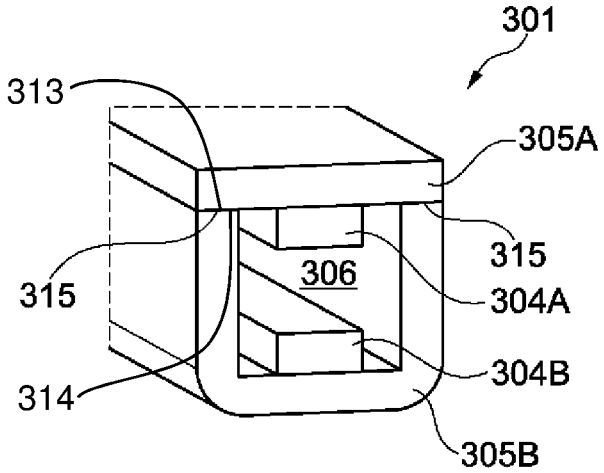

In FIG. 3B, the magnet assembly 301 comprises two magnet portions 304A, 304B and two shell parts 305A, 305B forming a common inner surface 307 encircling an inner space 306.

In the illustrated embodiment, the shell parts 305A, 305B are of different shape, as the upper shell part 305A is a substantially flat element, whereas the lower shell part 305B is U-shaped.

The shell parts 305A, 305B each comprises a first end face 313 and a second end face 314. The end faces 313, 314 abut each other in a joint 315 being parallel to the magnet portions 304A, 304B along the lower surface of the upper shell part 305A.

Figure 3C:
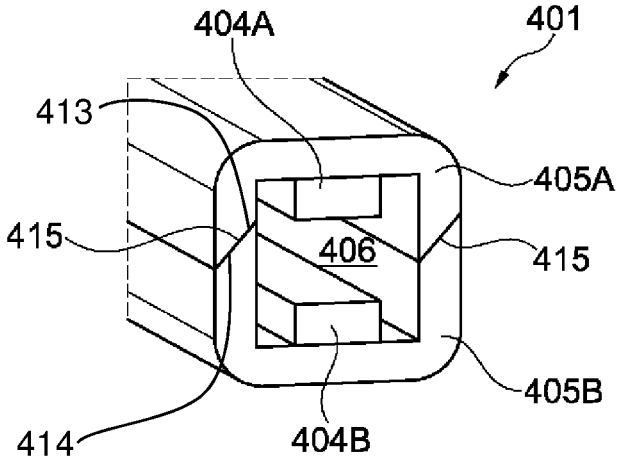

In FIG. 3C, the magnet assembly 401 is similar to the embodiment of FIG. 3A. However, the end faces 413, 414 abut each other in a joint 415 being transverse to the magnet portions 404A, 404B substantially centrally in a direction along the height of the magnet assembly 401.

By providing the end faces 413, 414 so that they extend transverse to the shell parts 405A, 405B, the area of the end faces is larger whereby the area of the joint 415 are larger than the area of the joint 215 of the embodiment illustrated in FIG. 3A.

Figure 3D:
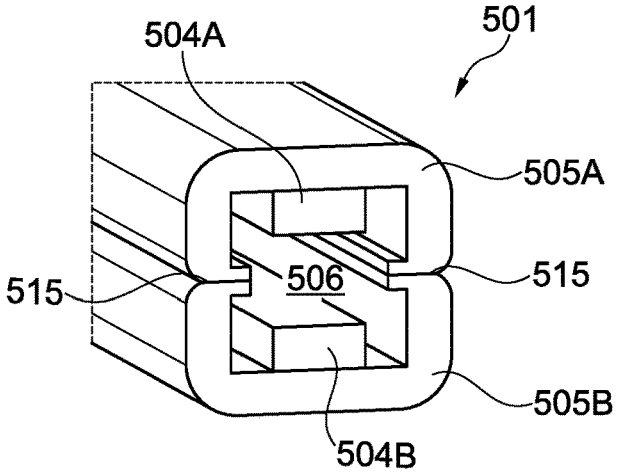

In FIG. 3D, the magnet assembly 501 comprises two magnet portions 504A, 504B and two shell parts 505A, 505B forming a common inner surface 507 encircling an inner space 506.

In the illustrated embodiment, the shell parts 505A, 505B are substantially identical. The end faces 513, 514 are formed at a portion of the shell parts 505A, 505B extending toward the centre of the inner space 506.

Figure 3E:
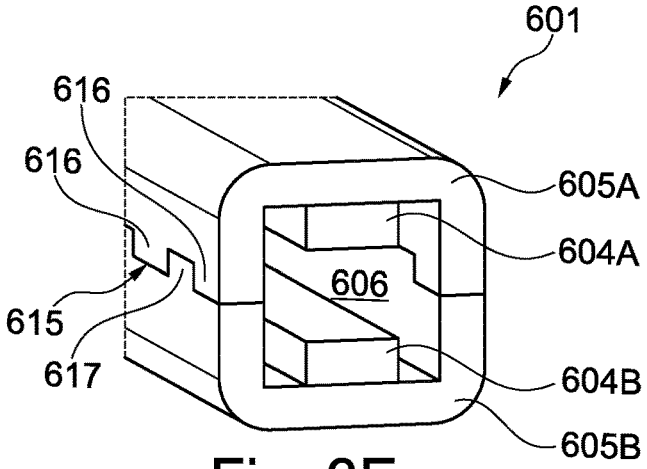

In FIG. 3E, the magnet assembly 601 is similar to the embodiments illustrated in FIGS. 3A and 3C. However, the end faces 613, 614 abut each other in a joint 615 substantially centrally in a direction along the height of the magnet assembly 601.

The end faces 613, 614 are each provided with a plurality of teeth 616, 617 which form a geometrically locking structure keeping the two shell parts 605A, 605B in a fixed position relative to each other. The teeth 616 of the upper shell part 605A are inserted into spaces of the lower shell part 605B, whereas the teeth 617 of the lower shell part 605B are inserted into spaces of the upper shell part 605A.

Figure 3F:
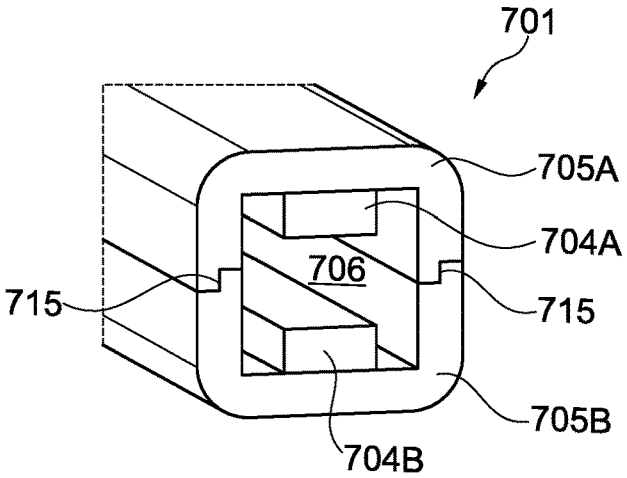

In FIG. 3F, the magnet assembly 701 is similar to the embodiments illustrated in FIGS. 3A, 3C, and 3E. However, the shell parts 705A, 705B which abut each other in a joint 715 substantially centrally in a direction along the height of the magnet assembly 701 each forms a step-shaped end portion 713, 714 thereby forming a geometrically locking structure which partly fixes the two shell parts 705A, 705B to each other.

Figure 3G:
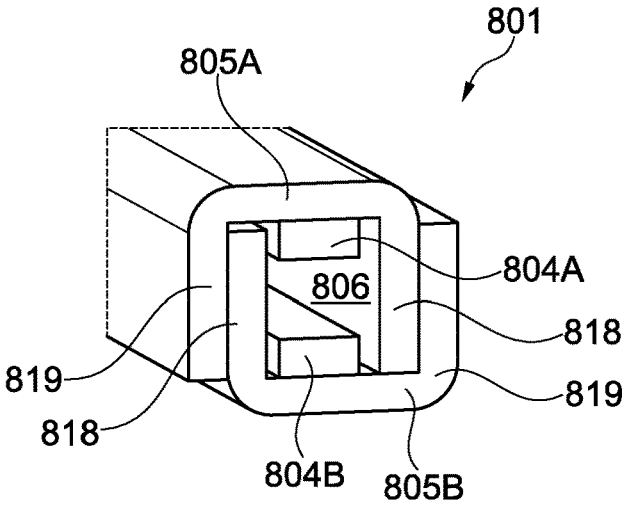

In FIG. 3G, the magnet assembly 801 comprises two magnet portions 804A, 804B and two shell parts 805A, 805B forming a common inner surface 807 encircling an inner space 806.

In the illustrated embodiment, the shell parts 805A, 805B are substantially identical, both being U-shaped.

However, instead of joining the shell parts 805A, 805B at the first and second end faces, the shell parts 805A, 805B are inserted into each other, so that one leg 818 of each of the U-shaped shell parts 805 is located in the inner space, and so that the other leg 819 is located outside the inner space 806. The overlapping areas along the legs 818, 819 increase the connection area of the two shell parts 805A, 805B.

Figure 3H:
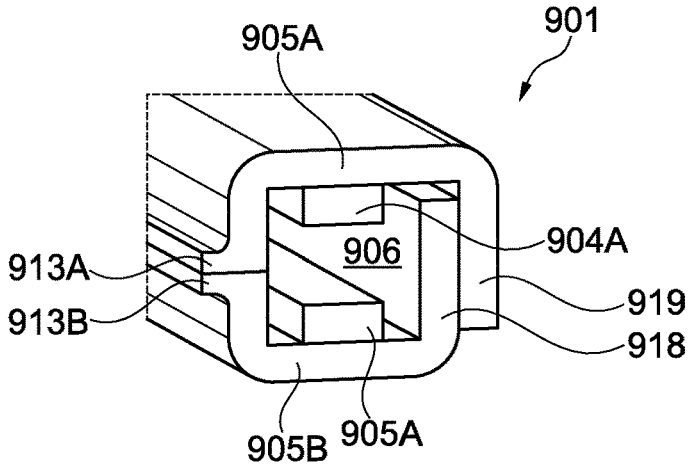

FIG. 3H, the magnet assembly 901 comprises two magnet portions 904A, 904B and two shell parts 905A, 905B forming a common inner surface 907 encircling an inner space 906. At one side, the magnet shell 905 is assembled by inserting one leg 918 of the U-shaped shell part 905B in the inner space, and by locating one leg 919 of the U-shaped shell part 905A outside the inner space 906. At the other side, the magnet shell 905 is assembled at the end faces 913A which extend away from the inner space 906.

Figure 3I:
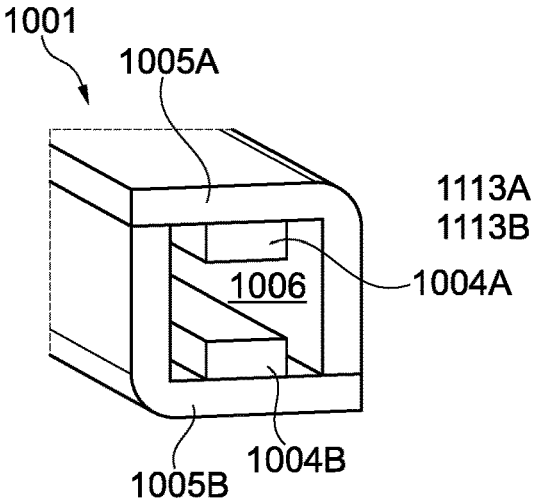
Figure 3J:
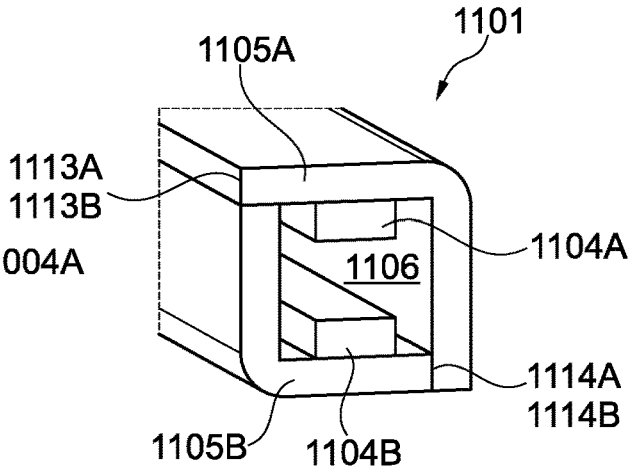

FIGS. 3I and 3J illustrate two similar embodiments of a magnet assembly 1001, 1101 each comprising two L-shaped shell parts 1005A, 1005B, 1105A, 1105B. The embodiment 1101 illustrated in FIG. 3I comprises two L-shaped shell part 1005A, 1005B of same size, whereas one of the L-shaped shell parts 1105A in FIG. 3J is larger than the other L-shaped shell part 1105B. By provided the L-shaped shell parts 1105A, 1105B of different size, the shape may assist when assembling the shell parts since they are at least partly self-assigning.

Figure 3K:
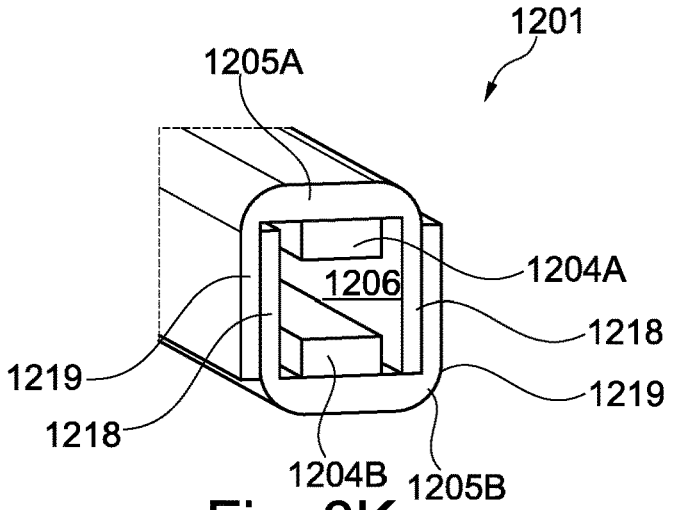

In FIG. 3K, the magnet assembly 1201 is similar to the embodiment illustrated in FIG. 3G. However, the thickness of the legs 1218, 1219 are approximately only half the thickness of the legs 818, 819 thereby reducing the total thickness of the magnet shell 1205 in the overlap between the legs 1218, 1219.

Figure 3L:
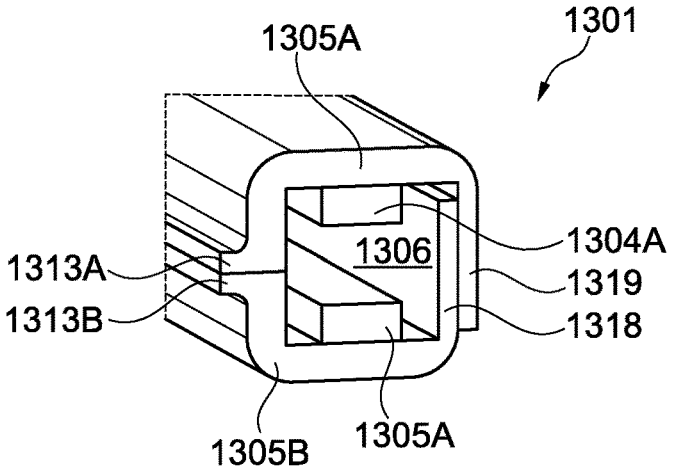

In FIG. 3L, the magnet assembly 1301 is similar to the embodiment illustrated in FIG. 3H. However, the thickness of the legs 1318, 1319 are approximately only half the thickness of the legs 918, 919 thereby reducing the total thickness of the magnet shell 1305 in the overlap between the legs 1318, 1319 at the right side of the magnet shell 1305.

Figure 3M:
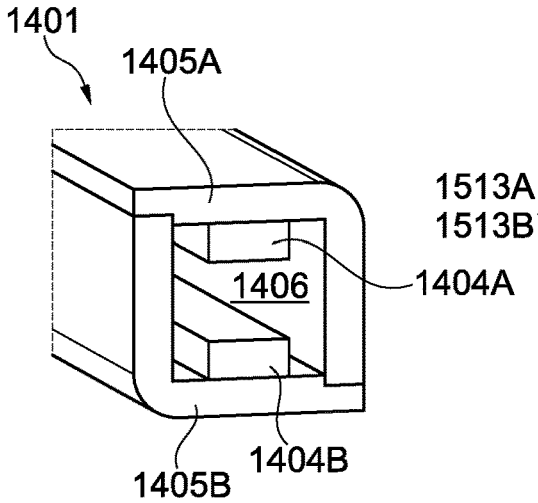

In FIG. 3M, the magnet assembly 1401 is similar to the embodiment illustrated in FIG. 3I. However, at one of the end parts the thickness of the shell parts 1405A, 1405B is reduced to approximately half the thickness of the remaining shell part. The reduced thickness will facilitate alignment of the two shell parts 1405A, 1405B as the other end part will fit into the indentation provided by the reduced thickness.

Figure 3N:
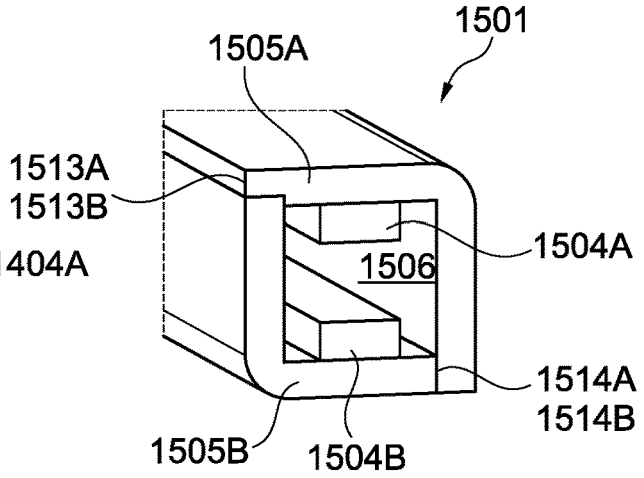

In FIG. 3N, the magnet assembly 1501 is similar to the embodiment illustrated in FIG. 3J. However, at one end part the thickness of the shell part 1505A is reduced to approximately half the thickness of the remaining shell part. The reduced thickness will facilitate alignment of the two shell parts 1505A, 1505B as one end part of the shell part 1505B will fit into the indentation provided by the reduced thickness of the shell part 1505A.

Figure 3O:
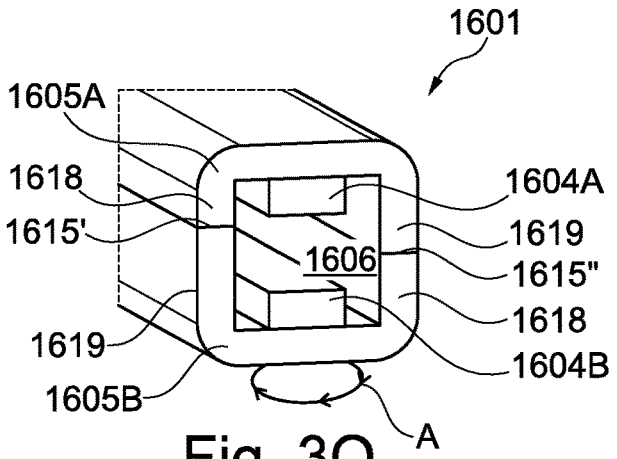

In FIG. 3O, the magnet assembly 1601 is similar to the embodiment illustrated in FIG. 3A. However, the end faces 1613, 1614 abut each other in joints 1615', 1615" at different heights of the magnet assembly 601, since the legs 1618, 1619 are of different length. When assembled as illustrated in FIG. 3O, the assembled magnet assembly 1601 is identical to the magnet assembly illustrated in FIG. 3A.

However, if the lower a shell part 1605B is rotated 180 degrees as indicated by the arrow A, the two long legs 1619 will join each other, while the two short legs 1618 will join each other. This will change the effective distance between the magnet portions 1604A, 1604B and thereby the magnet characteristics of the magnet assembly.

Figure 3P:
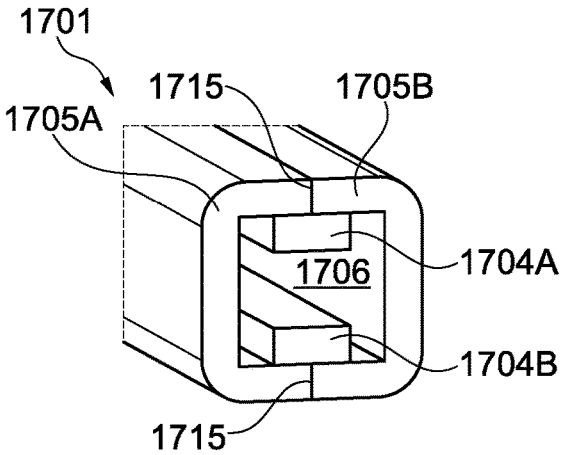

In FIG. 3P, the magnet assembly 1701 is similar to the embodiment illustrated in FIG. 3A. However, the end faces 1713, 1714 abut each other in a joint 1715 being arranged substantially centrally along the width of the magnet portions 1704A, 1704B; i.e. a vertically split magnet shell. Since the magnet portions 1704A, 1704B overlap the joints 1715, the required tolerances with regard to the assembling of the shell parts can be lowered.

Figure 3Q:
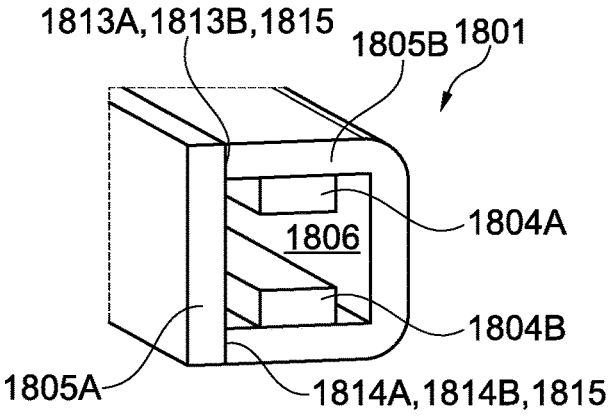

In FIG. 3Q, the magnet assembly 1801 is similar to the embodiment illustrated in FIG. 3B. The shell parts 1805A, 1805B are of different shape, as the left shell part 1805A is a substantially flat element, whereas the right shell part 1805B is U-shaped. The left shell part 1805A may form part of the armature thereby providing the ability of a smaller receiver. Preferably the armature may be U-shaped.

The end faces 1813, 1814 abut each other in a joint 1815 being perpendicular to the magnet portions 1804A, 1804B along the inner surface of the left shell part 1805A.

Figure 4:
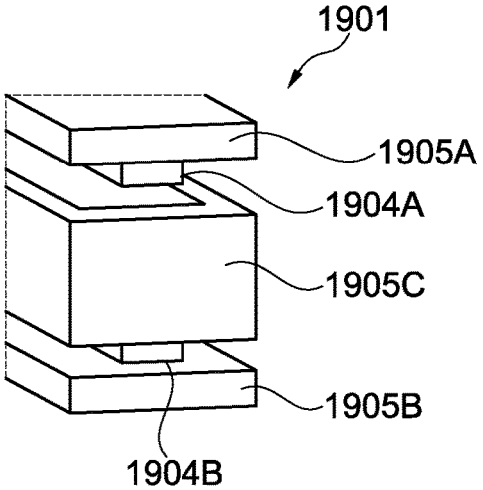
FIG. 4 illustrates a further alternative of an embodiment of a magnet assembly.

FIG. 4 illustrates a further alternative of an embodiment of a magnet assembly 1901, in which the magnet shell comprises three shell parts 1905A, 1905B, 1905C. The upper shell part 1905A and the lower shell part 1905B being joined by an intermediate shell part 1905C.

A magnet portion 1904A, 1904B is attached to each of the upper and lower shell part 1905A, 1905B.

The invention claimed is:

1. A receiver comprising a housing, an armature, and a magnet assembly, the armature and the magnet assembly being arranged in the housing, the magnet assembly comprising a magnet and a magnet shell, the magnet shell forming an inner space in which the magnet is provided, wherein at least a part of the armature extends in the inner space, wherein the magnet shell comprises at least two shell parts forming an inner surface substantially encircling the inner space, and wherein the shell parts each comprises a first and a second end face, and the first end face of a first shell part abuts one of the first and second end faces of an adjacent shell part, the second end face of the first shell part abuts one of the first and second ends faces of an adjacent shell part.

2. A receiver according to claim 1, wherein each shell part further comprises an outer surface part and an inner surface part, the end faces forming an edge arranged in the transition between the outer surface part and the inner surface part, wherein each outer surface part forms part of the outer surface of the magnet shell and each inner surface part forms part of the inner surface encircling the inner space, when each end face of a shell part abuts an end face of an adjacent shell part.

3. A receiver according to claim 2, wherein the magnet comprises a first magnet portion and a second magnet portion, the first magnet portion and the second magnet portion being attached to different shell parts.

4. A magnet assembly for a receiver according to claim 2, the magnet assembly comprising a magnet and a magnet shell, the magnet shell forming an inner space in which the magnet is provided, wherein the magnet shell comprises at least two shell parts forming an inner surface substantially encircling the inner space, and wherein the shell parts each comprises a first and a second end face, and the first end face of a first shell part abuts one of the first and second end faces of an adjacent shell part, the second end face of the first shell part abuts one of the first and second ends faces of an adjacent shell part.

5. A receiver according to claim 1, further comprising an alignment structure for alignment of the at least two shell parts.

6. A receiver according to claim 5, wherein the alignment structure forms part of the magnet shell.

7. A receiver according to claim 6, wherein the alignment structure comprises an indentation formed at an end portion of at least one of the shell parts, the indentation forming a shape matching a shape of an end portion of another shell part.

8. A receiver according to claim 5, wherein the alignment structure comprises an indentation formed at an end portion of at least one of the shell parts, the indentation forming a shape matching a shape of an end portion of another shell part.

9. A receiver according to claim 5, wherein the alignment structure comprises a geometrical locking structure forming part of the shell parts.

10. A receiver according to claim 1, wherein the magnet comprises a first magnet portion and a second magnet portion, the first magnet portion and the second magnet portion being attached to different shell parts.

11. A receiver according to claim 1, wherein the shell parts have a thickness being a distance from the inner surface to an opposite outer surface, the thickness being non-uniform along the inner space.

12. A method of manufacturing a magnet assembly according to claim 1, the method comprising the step of;

providing a magnet, providing at least two shell parts each comprising a first and a second end face, providing a housing, providing an armature, assembling the at least two shell parts to form a magnet shell having an inner space with an inner surface substantially encircling the inner space, so that the first end face of a first shell part abuts one of the first and second end faces of an adjacent shell part, and the second end face of the first shell part abuts one of the first and second end faces of an adjacent shell part, attaching the magnet to at least one of the shell parts, and arranging the magnet shell and the armature in the housing.

13. A method according to claim 12, wherein the step of attaching the magnet to at least one of the shell parts is carried out prior to assembling the shell parts to form a magnet shell.

14. A method according to claim 13, wherein the step of attaching the magnet comprises a step of attaching a first magnet portion to a first shell part and a step of attaching a second magnet portion to a second shell part.

15. A method according to claim 13, comprising a step of magnetizing the magnet prior to the step of assembling the magnet shell.

16. A method according to claim 13, wherein the magnet is attached to one of the shell parts prior to a step of releasing the shell part from a carrier material to which it is attached during manufacturing of the shell part.

17. A method according to claim 12, comprising a step of magnetizing the magnet prior to the step of assembling the magnet shell.

18. A method according to claim 12, wherein the step of assembling the magnet shell comprises a step of gluing the shell parts together.

19. A method according to claim 12, wherein the magnet is attached to one of the shell parts prior to a step of releasing the shell part from a carrier material to which it is attached during manufacturing of the shell part.

20. A magnet assembly for a receiver according to claim 1, the magnet assembly comprising a magnet and a magnet shell, the magnet shell forming an inner space in which the magnet is provided, wherein the magnet shell comprises at least two shell parts forming an inner surface substantially encircling the inner space, and wherein the shell parts each comprises a first and a second end face, and the first end face of a first shell part abuts one of the first and second end faces of an adjacent shell part, the second end face of the first shell part abuts one of the first and second ends faces of an adjacent shell part.

* * * * *